US007393438B2

(12) United States Patent
Marsden et al.

(10) Patent No.: US 7,393,438 B2
(45) Date of Patent: Jul. 1, 2008

(54) APPARATUS FOR PRODUCING METAL POWDER BY ELECTROWINNING

(75) Inventors: John O Marsden, Phoenix, AZ (US); Scot P Sandoval, Morenci, AZ (US); Antonioni C Stevens, Thatcher, AZ (US); Timothy G Robinson, Scottsdale, AZ (US); Stanley R Gilbert, Thatcher, AZ (US)

(73) Assignee: Phelps Dodge Corporation, Phoenix, AZ (US)

( * ) Notice: Subject to any disclaimer, the term of this patent is extended or adjusted under 35 U.S.C. 154(b) by 232 days.

(21) Appl. No.: 11/160,909

(22) Filed: Jul. 14, 2005

(65) Prior Publication Data

US 2006/0016684 A1 Jan. 26, 2006

Related U.S. Application Data

(60) Provisional application No. 60/590,883, filed on Jul. 22, 2004.

(51) Int. Cl.
*C25B 9/00* (2006.01)

(52) U.S. Cl. ..... 204/269; 204/267; 204/275.1; 204/278.5; 204/281; 204/284

(58) Field of Classification Search ..... 204/281, 204/267, 269, 275.1, 278.5; 205/574, 575, 205/576, 588, 602, 603
See application file for complete search history.

(56) References Cited

U.S. PATENT DOCUMENTS

| | | | |
|---|---|---|---|
| 2,792,342 | A | 5/1957 | Tuwiner |
| 3,262,870 | A | 7/1966 | Harlan |
| 3,616,277 | A | 10/1971 | Adamson et al. |
| 3,876,516 | A | 4/1975 | Pace et al. |
| 3,887,396 | A | 6/1975 | Walsh et al. |
| 3,915,834 | A | 10/1975 | Wright et al. |
| 3,956,086 | A | 5/1976 | Wilkinson et al. |
| 3,972,795 | A | 8/1976 | Goens et al. |
| 4,071,431 | A | 1/1978 | Nicou et al. |
| 4,219,401 | A | 8/1980 | Johnson |
| 4,226,685 | A | 10/1980 | Portal et al. |
| 4,272,339 | A | 6/1981 | Knight et al. |
| 4,278,521 | A | 7/1981 | Kreysa |

(Continued)

FOREIGN PATENT DOCUMENTS

| | | |
|---|---|---|
| CA | 1162514 | 2/1984 |

(Continued)

OTHER PUBLICATIONS

Alkire, R., et al., "Flow Through Porous Electrodes;" J. Electrochem Soc.; 122, 1594; 1975.

Marracino, J.M., et al., "A First Investigation of Flow-Through Porous Electrodes Made of Metallic Felts or Foams;" Electrochim. Acta; 32, 1303; 1987.

(Continued)

*Primary Examiner*—Bruce F Bell
(74) *Attorney, Agent, or Firm*—Snell & Wilmer L.L.P.

(57) ABSTRACT

This invention relates to an apparatus for producing a metal powder product using either conventional electrowinning or alternative anode reaction chemistries in a flow-through electrowinning cell. A new design for a flow-through electrowinning cell that employs both flow-through anodes and flow-through cathodes is described. The present invention enables the production of high quality metal powders, including copper powder, from metal-containing solutions using conventional electrowinning processes, direct electrowinning, or alternative anode reaction chemistry.

19 Claims, 3 Drawing Sheets

U.S. PATENT DOCUMENTS

| | | | | |
|---|---|---|---|---|
| 4,292,160 | A | 9/1981 | Marcantonio | |
| 4,318,789 | A | 3/1982 | Marcantonio | |
| 4,373,654 | A | 2/1983 | Prengaman et al. | |
| 4,399,020 | A * | 8/1983 | Branchick et al. | 204/269 |
| 4,436,601 | A | 3/1984 | Branchick et al. | |
| 4,445,990 | A | 5/1984 | Kim et al. | |
| 4,515,672 | A | 5/1985 | Platek et al. | |
| 4,556,469 | A | 12/1985 | Kim et al. | |
| 4,560,453 | A | 12/1985 | Hoffman et al. | |
| 4,680,100 | A | 7/1987 | Morin | |
| 4,715,934 | A | 12/1987 | Tamminen | |
| 4,762,603 | A | 8/1988 | Morin | |
| 4,776,941 | A | 10/1988 | Tezanos et al. | |
| 4,789,450 | A | 12/1988 | Paterson | |
| 4,834,850 | A | 5/1989 | de Nora et al. | |
| 4,863,580 | A | 9/1989 | Epner | |
| 4,960,500 | A | 10/1990 | Epner | |
| 5,006,216 | A | 4/1991 | Dietrich et al. | |
| 5,133,843 | A | 7/1992 | Eisman | |
| 5,292,412 | A | 3/1994 | Pitton | |
| 5,324,409 | A | 6/1994 | Mayr et al. | |
| 5,368,702 | A | 11/1994 | de Nora | |
| 5,454,917 | A | 10/1995 | Mattison et al. | |
| 5,458,746 | A | 10/1995 | Burgess et al. | |
| 5,492,608 | A | 2/1996 | Sandoval et al. | |
| 5,622,615 | A | 4/1997 | Young et al. | |
| 5,690,806 | A | 11/1997 | Sunderland et al. | |
| 5,705,048 | A | 1/1998 | Oxley et al. | |
| 5,725,752 | A | 3/1998 | Sunderland et al. | |
| 5,770,037 | A | 6/1998 | Goto et al. | |
| 5,783,050 | A | 7/1998 | Coin et al. | |
| 5,837,122 | A | 11/1998 | Snyder et al. | |
| 5,882,502 | A | 3/1999 | Gomez | |
| 5,972,181 | A | 10/1999 | Coin et al. | |
| 6,017,428 | A | 1/2000 | Hill et al. | |
| 6,086,691 | A | 7/2000 | Lehockey et al. | |
| 6,086,733 | A | 7/2000 | Carey et al. | |
| 6,113,758 | A | 9/2000 | de Nora et al. | |
| 6,139,705 | A | 10/2000 | Brown, Jr. et al. | |
| 6,149,797 | A | 11/2000 | Carey et al. | |
| 6,214,179 | B1 | 4/2001 | Cartner | |
| 6,352,622 | B1 | 3/2002 | Brown et al. | |
| 6,398,939 | B1 | 6/2002 | Huens et al. | |
| 6,402,930 | B1 | 6/2002 | Allen et al. | |
| 6,451,183 | B1 * | 9/2002 | Treasure et al. | 204/272 |
| 2004/0168909 | A1 | 9/2004 | Larson | |
| 2005/0023151 | A1 | 2/2005 | Sandoval et al. | |
| 2006/0226024 | A1 * | 10/2006 | Sandoval et al. | 205/576 |

FOREIGN PATENT DOCUMENTS

| | | | |
|---|---|---|---|
| DE | 19731616 | | 1/1999 |
| EP | 0129845 | | 10/1988 |
| EP | 0206941 | | 10/1990 |
| FR | 2810681 | | 12/2001 |
| JP | 02-229778 | | 9/1990 |
| RU | 2121411 | C1 | 11/1988 |
| RU | 2169443 | | 6/2001 |
| SU | 589290 | | 1/1978 |
| SU | 715900 | | 2/1980 |
| SU | 1090760 | A1 | 5/1984 |
| SU | 1183566 | A1 | 10/1985 |
| SU | 1243907 | A1 | 7/1986 |
| SU | 1346697 | A1 | 10/1987 |
| SU | 1418349 | A1 | 8/1988 |
| SU | 1537711 | A1 | 1/1990 |
| SU | 1708939 | A1 | 1/1992 |
| SU | 1813806 | A1 | 5/1993 |
| WO | WO 97/14825 | | 4/1997 |
| WO | WO 00/043576 | | 7/2000 |
| WO | WO 2005/012597 | | 2/2005 |

OTHER PUBLICATIONS

Popov, K. I., et al., "The Comparison of Galvanostatis . . . Aluminum Electrodes," Journal of Applied Electrochemistry, v. 8, pp. 503-514.

Qi, J. et al., "Analysis of Flow-Through Porous Electrode . . . ;" J. Appl. Electrochem.; 23, 873; 1993.

Saleh, M.M., et al., "Electrowinning of Non-Noble Metals with Simultaneous Hydrogen Evolution at Flow Through Porous Electrodes;" J. Electrochem. Soc.; 142, 4122; 1995.

Smirnov, B. N., et al., "Mechanism of the Cathodic . . . ," Trans. from Porosh. Metallurgiya, No. 3 (291), pp. 1-4 (1987) (Orig. article submit Mar. 25, 1986).

Usol'tseva, E. E., et al., "Production of Electrolytic Copper Powders . . . ;" Translated form Porosh. Metallur., No. 11 (299), pp. 4-8 (Nov. 1987). (Orig. art. sub. Dec. 29, 1986).

Allen, R. J., et al., "Energy Savings by Means of Fuel . . . ," Dept. of Energy, Jrn. Annc.: GRAI8018, NSA0500, 72 p. (Mar. 19, 1979). [Abstract].

Barbosa, Fernando Jr., et al.; "On-line Coupling of Electrochem. Precon . . . ;" Spectro. Acta-Part B Atomic Spectr., V. 54, N. 8, p. 1155-1166 (1999). [Abstract Only.].

Bechtold, Thomas, et al., "Optimization of Multi-Cathode . . . ; " Chem. Eng. & Tech., V. 21, N. 11, p. 877-880 (Nov. 1998). [Abstrat Only].

Chin, Der-Tau, "Metal Recovery from Wastewater with an Electrochemical Method," Chemical Engineering Education, V. 36, N. 2 (Spring 2002). [Abstract Only].

Cook; G.M., et al., "Electrodeposition of Copper in Flow-Through Cathodes," Abstracts from Electrochemical Society Fall Meeting/ Electrochem. Society, p. 76-77 (Oct. 1976).

Ford, et al., "User Data Package for Implemen . . . ," Naval Faci. Eng. Svc. Ctr., Port Hueneme, CA, Report No.: NFESC-TR-2046-ENV, 83 p., (Oct. 1995). [Abstract].

Jorne, Jacob, et al., "Suppression of Dendrites and . . . ;" Journ. of the Elec. Soc., V. 134, N. 6, p. 1399-1402 (Jun. 1987). [Abstract Only].

Lemon, Charles E., et al., "Electrolytic Cell Provides New . . .," Conf.: Proc. AESF/EPA Conf. for Envir. Excell., Orl., FL (Jan. 2000), Sponsor: Amer. Elec. and Sur . . . [Abstract].

Scholder, B., et al., "Study of a Porous Cathode . . . ," Conf.: Extended Abstracts, 34th Meeting-Int'l Soc. of Electrochem., Erlangen, W. Ger. (Sep. 18, 1983). [Abstract].

Smith, Wayne H., et al., "Electrowinning/Electrostripping . . . ," Conf.: Proc. of the 1995 9th Symp . . . , Sep. Sci. and Tech, V. 32, No. 1-4, p. 669-679 (Jan.-Feb. 1997). [Abstract].

Varentsov, V.K., et al., "Electrochemical Extraction of Copper . . . ," Sov. Electro. (English Trans. Of Elektro-Khimiia), V. 18, N. 3, p. 326-329 (Mar. 1982). [Abstr. Only].

Zamyatin, A. P., et al., "Experimental Study of the Factors . . . ;" Sov. Electr. (Eng. Trans. of Elektro-Khimiia), V. 20, N. 6, p. 795-797 (Jun. 1984). [Abstract Online].

International Search Report/Written Opinion dated Feb. 16, 2007.

International Preliminary Report on Patentability dated Mar. 6, 2007.

Wiechmann, et al.; "The use of segmented intercell bars in electrowinning plants"; Electrometallurgy 2001, pp. 261-272.

Sandoval, et al.; "A substituted anode reaction for electrowinning copper"; Proceedings of COPPER95-COBRE 95 International Conference, vol. III—Electrorefining and Hydrometallurgy of Copper, pp. 423-435.

Sandoval, et al.; "Evaluation of the Ferrous/Ferric-Sulfur Dioxide Anode Reaction for Integration Into the Copper Leaching-Solvent Extraction-Electrowinning Circuit"; Chapter 66, Reno Research Center, U.S. Bureau of Mines, pp. 1091-1105.

Duby, Paul; "The History of Progress in Dimensionally Stable Anodes", JOM, Mar. 1993, pp. 41-43.

Dolinar, et al.; "Copper Electrowinning in the Absence of Acid Misting Using the Ferrous/Ferric-Sulfur Dioxide Anode Reaction—A Pilot Study"; Society for Mining, Metallurgy and Exploration, Inc., Transactions vol. 298, pp. 1936-1942, SME Annual Meeting, Mar. 6-9, 1995.

* cited by examiner

APPARATUS FOR PRODUCING METAL POWDER BY ELECTROWINNING

CROSS-REFERENCE TO RELATED APPLICATIONS

This application claims priority to U.S. Provisional Application No. 60/590,883 filed Jul. 22, 2004, which provisional application, in its entirety, is hereby incorporated by reference.

FIELD OF INVENTION

This invention relates to an apparatus for producing metal powder using electrowinning. In particular, this invention relates to an apparatus for producing a copper powder product using either conventional electrowinning chemistry or alternative anode reaction chemistry in a flow-through electrowinning cell.

BACKGROUND OF INVENTION

Conventional copper electrowinning processes produce copper cathode sheets. Copper powder, however, is an alternative to solid copper cathode sheets. Production of copper powder as compared to copper cathode sheets can be advantageous in a number of ways. For example, it is potentially easier to remove and handle copper powder from an electrowinning cell, as opposed to handling relatively heavy and bulky copper cathode sheets. In traditional electrowinning operations yielding copper cathode sheets, harvesting typically occurs every five to eight days, depending upon the operating parameters of the electrowinning apparatus. Copper powder production has the potential, however, of being a continuous or semi-continuous process, so harvesting may be performed on a substantially continuous basis, therefore reducing the amount of "work-in-process" inventory as compared to conventional copper cathode production facilities. Also, there is potential for operating copper electrowinning processes at higher current densities when producing copper powder than with conventional electrowinning processes that produce copper cathode sheets, capital costs for the electrowinning cell equipment may be less on a per unit of production basis, and it also may be possible to lower operating costs with such processes. It is also possible to electrowin copper effectively from solutions containing lower concentrations of copper than using conventional electrowinning at acceptable efficiencies. Moreover, copper powder exhibits superior melting characteristics over copper cathode sheets and copper powder may be used in a wider variety of products than can conventional copper cathode sheets. For example, it may be possible to directly form rods, shapes, and other copper and copper alloy products from copper powder.

Conventional cathodes used in conventional electrowinning cells do not allow electrolyte to flow through the cathode, and the mass transport at the surface of the cathode depends on the efficiency of electrolyte mixing between and among the cathodes in the electrowinning cell. The present inventors have recognized that a flow-through cathode design that would allow a significant increase in mass transport of relevant species to and from the cathode and the anode by improving the overall flow characteristics through an electrowinning cell would be advantageous, particularly for a copper powder production process. In particular, when one or more flow-through cathodes are utilized in combination with one or more flow-through anodes within the electrowinning cell, significant enhancements to mass transport of ionic species to and from the surfaces of the anodes and cathodes can be achieved.

SUMMARY OF INVENTION

The present invention provides a new flow-through electrowinning cell that accommodates both flow-through anodes and flow-through cathodes. This allows for the production of high quality copper powder from copper-containing solutions using conventional electrowinning chemistry processes (i.e., oxygen evolution at the anode), direct electrowinning processes (i.e., electrowinning copper from copper-containing solution without the use of solvent extraction or without the use of other methods for concentration of copper in solution, such as ion exchange, ion selective membrane technology, solution recirculation, evaporation, and other methods), and alternative anode reaction electrowinning processes (i.e., oxidation of ferrous ion to ferric ion at the anode). In addition, the present invention provides an option for electrowinning copper from relatively dilute copper-containing solutions, such as solutions containing less than about 20 grams per liter of copper, and various blends of solutions.

In accordance with various embodiments of the present invention, an apparatus for producing copper powder includes an electrowinning cell having (i) one or more flow-through anodes, (ii) one or more flow-through cathodes, and (iii) a suitable electrolyte flow system. The flow-through design improves mass transport of relevant ionic species to and from the anodes and the cathodes at the same flow rate as conventional electrowinning cells, yet also allows electrolyte flow rates through the cell to be increased significantly above flow rates used for conventional copper electrowinning, direct electrowinning, or alternative anode reaction chemistries.

In accordance with various aspects of the present invention, the process and apparatus for electrowinning copper powder from a copper-containing solution are configured to optimize copper powder particle size and other material properties such as apparent density and surface area, to optimize cell operating voltage, current efficiency and overall power requirements, to maximize the ease of harvesting copper powder from the cathode, and to optimize copper concentration in the lean electrolyte stream leaving the electrowinning operation. Additionally, various aspects of the present invention enable enhancements in process ergonomics and process safety while achieving improved process economics.

These and other advantages of an apparatus for producing copper powder by electrowinning according to various aspects and embodiments of the present invention will be apparent to those skilled in the art upon reading and understanding the following detailed description with reference to the accompanying figures.

BRIEF DESCRIPTION OF THE DRAWINGS

The subject matter of the present invention is particularly pointed out and distinctly claimed in the concluding portion of the specification. A more complete understanding of the present invention, however, may best be obtained by referring to the detailed description and claims when considered in connection with the drawing figures, wherein like numerals denote like elements and wherein:

DETAILED DESCRIPTION

Figure 1:
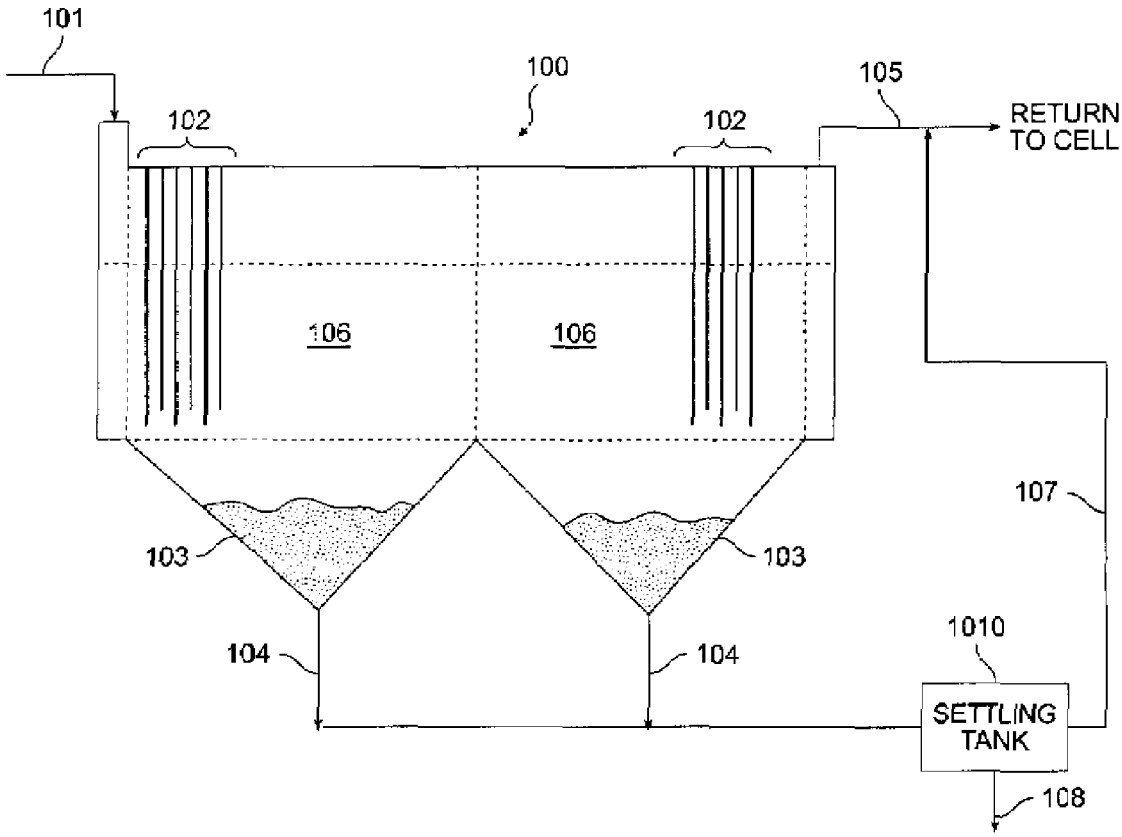
FIG. 1 is a process diagram including an electrowinning cell in accordance with one exemplary embodiment of the present invention.

The present invention exhibits significant advancements over prior art apparatus, and enables significant improvements in copper product quality and process efficiency. Moreover, existing copper recovery processes that utilize conventional electrowinning apparatus may, in many instances, be retrofitted to exploit the many commercial benefits the present invention provides.

As an initial matter, it should be understood that various embodiments of the present invention may be successfully employed to produce high quality copper powder from copper-containing solutions using conventional electrowinning chemistry (i.e., oxygen evolution at the anode) following the use of solvent extraction and/or other methods for concentration of copper in solution, such as ion exchange, ion selective membrane technology, solution recirculation, evaporation, and other methods, direct electrowinning (i.e., electrowinning copper from copper-containing solution without the use of solvent extraction techniques or without the use of other methods for concentration of copper in solution, such as ion exchange, ion selective membrane technology, solution recirculation, evaporation, and other methods), and alternative anode reaction electrowinning chemistry (i.e., oxidation of ferrous ion to ferric ion at the anode). Conventional copper electrowinning occurs by the following reactions:

Cathode reaction:

$$Cu^{2+}+SO_4^{2-}+2e^-\rightarrow Cu^0+SO_4^{2-}\ (E^0=+0.345\ V)$$

Anode reaction:

$$H_2O\rightarrow \tfrac{1}{2}O_2+2H^++2e^-\ (E^0=-1.230\ V)$$

Overall cell reaction:

$$Cu^{2+}+SO_4^{2-}+H_2O\rightarrow Cu^0+2H^++SO_4^{2-}+\tfrac{1}{2}O_2(E^0=-0.885\ V)$$

So-called conventional copper electrowinning chemistry and electrowinning apparatus are known in the art. Conventional electrowinning operations typically operate at current densities in the range of about 220 to about 400 Amps per square meter of active cathode (20-35 A/ft$^2$), and most typically between about 300 and about 350 A/m$^2$ (28-32 A/ft$^2$). Using additional electrolyte circulation and/or air injection into the cell allows higher current densities to be achieved (e.g., 400-500 A/m$^2$).

Alternative anode reaction electrowinning, on the other hand, occurs by the following reactions:

Cathode reaction:

$$Cu^{2+}+SO_4^{2-}+2e^-\rightarrow Cu^0+SO_4^{2-}\ (E^0=+0.345\ V)$$

Anode reaction:

$$2Fe^{2+}\rightarrow 2Fe^{3+}+2e^-\ (E^0=-0.770\ V)$$

Overall cell reaction:

$$Cu^{2+}+SO_4^{2-}+2Fe^{2+}\rightarrow Cu^0+2Fe^{3+}+SO_4^{2-}\ (E^0=-0.425\ V)$$

The ferric iron generated at the anode as a result of this overall cell reaction can be reduced back to ferrous iron using sulfur dioxide, as follows:

Solution reaction:

$$2Fe^{3+}+SO_2+2H_2O\rightarrow 2Fe^{2+}+4H^++SO_4^{2-}$$

Various embodiments of the present invention employing alternative anode reaction chemistries are expected to be able to operate effectively and produce high quality copper powder at current densities up to about 1100 A/m$^2$ and possibly higher. For example, U.S. patent application Ser. No. 10/629,497, filed Jul. 28, 2003 and entitled "Method and Apparatus for Electrowinning Copper Using the Ferrous/Ferric Anode Reaction" discloses a process for electrowinning utilizing the ferrous/ferric anode reaction, and the disclosure of that application is incorporated by reference herein.

With initial reference to FIG. 1, an exemplary electrowinning apparatus 100 is provided in accordance with various aspects of one embodiment of the present invention. Electrowinning apparatus 100 is illustrated in FIG. 1 as comprising multiple electrowinning cells 106 configured in series or otherwise electrically connected, each comprising a series of electrodes 102—alternating anodes and cathodes. In accordance with one aspect of an exemplary embodiment, each electrowinning cell or portion of an electrowinning cell comprises between about 4 and about 80 anodes and between about 4 and about 80 cathodes. In accordance with one aspect of another exemplary embodiment, each electrowinning cell or portion of an electrowinning cell comprises from about 15 to about 40 anodes and about 16 to about 41 cathodes. However, it should be appreciated that in accordance with the present invention, any number of anodes and/or cathodes may be utilized. Each electrowinning cell or portions of each electrowinning cell may preferably be configured with a base portion having a collecting configuration, such as, for example, a conical-shaped or trench-shaped base portion, which collects the copper powder product harvested from the cathodes for removal from the electrowinning cell. For purposes of this detailed description of preferred embodiments of the invention, the term "cathode" refers to a complete negative electrode assembly (typically connected to a single bar). For example, in a cathode assembly comprising multiple thin rods suspended from a bar, the term "cathode" is used to refer to the group of thin rods, and not to a single rod.

In operation of electrowinning apparatus 100, a copper-containing solution 101 enters the electrowinning apparatus, preferably from one end and/or through an electrolyte injection manifold system, and flows through the apparatus (and thus past the electrodes), during which copper is electrowon from the solution to form copper powder. A copper powder slurry stream 104, which comprises the copper powder product and some electrolyte, collects in base portion 103 and is thereafter removed, while a lean electrolyte stream 105 exits the apparatus from a side or top portion of the apparatus, preferably from an area generally opposite the entry point of the copper-containing solution to the apparatus.

In accordance with one aspect of an exemplary embodiment of the invention, at least a portion of lean electrolyte stream 105 may be returned to electrowinning cell 101. Moreover, fine copper powder that is carried through the cell with the electrolyte may preferably be removed via a suitable filtration, sedimentation, or other fines removal/recovery system prior to reintroducing the electrolyte stream to the electrowinning apparatus.

With further reference to FIG. 1, in accordance with another aspect of an exemplary embodiment of the invention, after leaving electrowinning apparatus 100, copper powder slurry stream enters an optional settling tank 1010 or other apparatus configured to allow gravitational separation of copper powder particles from excess electrolyte. Excess electrolyte 107 is preferably removed from settling tank 1010 through a side or top exit point, and at least a portion of excess electrolyte 107 may be returned to electrowinning apparatus 100. A concentrated copper powder slurry 108 exits settling tank 1010 and is preferably subjected to additional processing to produce a final copper powder product.

While not illustrated in FIG. 1, in accordance with an optional aspect of an exemplary embodiment of the invention, a hood, cover, brush configuration, or other device is installed above the electrowinning apparatus to remove and/or recover acid mist resulting from conventional electrowinning reactions.

Anode Characteristics

Figure 2:
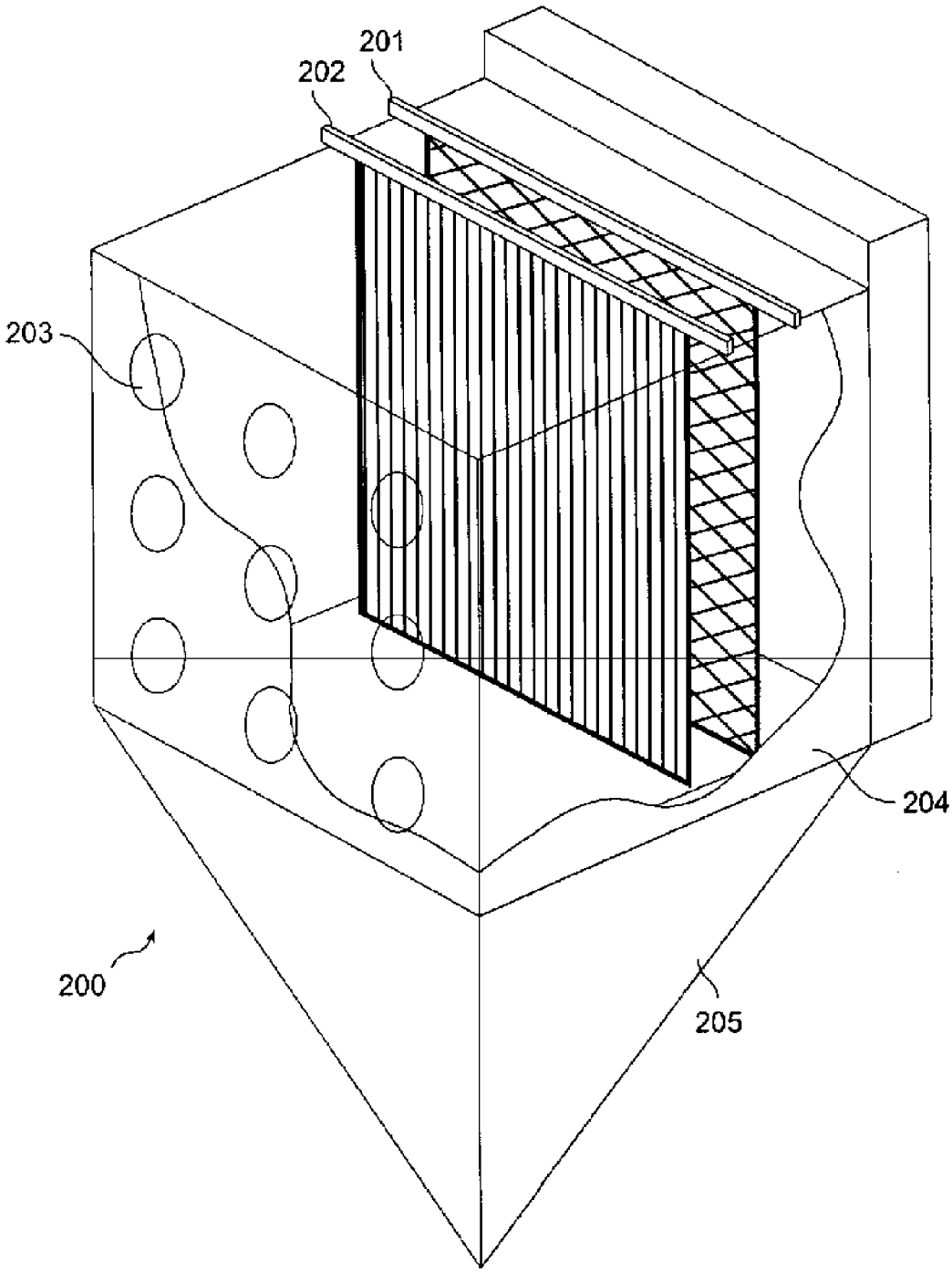
FIG. 2 illustrates a flow-through electrowinning cell in accordance with one exemplary embodiment of the present invention.
Figure 3:
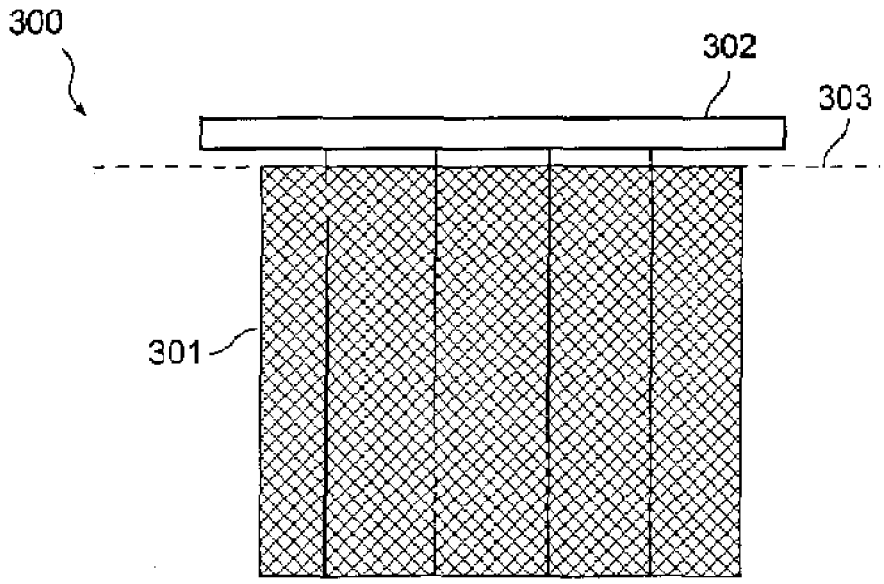
FIG. 3 illustrates the configuration of a flow-through anode in accordance with various aspects of another exemplary embodiment of the present invention.

In accordance with one exemplary embodiment of the present invention, a flow-through anode, such as anode 300 illustrated in FIG. 3, is incorporated into the cell as shown in FIG. 2 (i.e., anode 201). As used herein, the term "flow-through anode" refers to any anode configured to enable electrolyte to pass through it. While fluid flow from an electrolyte flow manifold provides electrolyte movement, a flow-through anode allows the electrolyte in the electrochemical cell to flow through the anode during the electrowinning process. Any now known or hereafter devised flow-through anode may be utilized in accordance with various aspects of the present invention. Possible configurations include, but are not limited to, metal, metal wool, metal fabric, other suitable conductive nonmetallic materials (e.g., carbon materials), an expanded porous metal structure, metal mesh, expanded metal mesh, corrugated metal mesh, multiple metal strips, multiple metal wires or rods, woven wire cloth, perforated metal sheets, and the like, or combinations thereof. Moreover, suitable anode configurations are not limited to planar configurations, but may include any suitable multiplanar geometric configuration.

Anodes employed in conventional electrowinning operations typically comprise lead or a lead alloy, such as, for example, Pb—Sn—Ca. One significant disadvantage of using such anodes is that, during the electrowinning operation, small amounts of lead are released from the surface of the anode and ultimately cause the generation of undesirable sediments, "sludges," particulates suspended in the electrolyte, other corrosion products, or other physical degradation products in the electrochemical cell and cause contamination of the copper product. For example, copper produced in operations employing a lead-containing anode typically comprises lead contaminant at a level of from about 0.5 ppm to about 15 ppm. In accordance with one aspect of a preferred embodiment of the present invention, the anode is substantially lead-free. Thus, generation of lead-containing sediments, "sludges," particulates suspended in the electrolyte, or other corrosion or physical degradation products and resultant contamination of the copper powder with lead from the anode is avoided. In conventional electrowinning processes using such lead anodes, another disadvantage is the need for cobalt to control the surface corrosion characteristics of the anode, to control the formation of lead oxide, and/or to prevent the deleterious effects of manganese in the system.

In accordance with one aspect of an exemplary embodiment of the invention, the anode is formed of one of the so-called "valve" metals, including titanium (Ti), tantalum (Ta), zirconium (Zr), or niobium (Nb). Where suitable for the process chemistry being utilized in the electrowinning cell, the anode may also be formed of other metals, such as nickel (Ni), stainless steel (e.g., Type 316, Type 316L, Type 317, Type 310, etc.), or a metal alloy (e.g., a nickel-chrome alloy), intermetallic mixture, or a ceramic or cermet containing one or more valve metals. For example, titanium may be alloyed with nickel, cobalt (Co), iron (Fe), manganese (Mn), or copper (Cu) to form a suitable anode. Preferably, in accordance with one exemplary embodiment, the anode comprises titanium, because, among other things, titanium is rugged and corrosion-resistant. Titanium anodes, for example, when used in accordance with various embodiments of the present invention, potentially have useful lives of up to fifteen years or more.

The anode may also optionally comprise any electrochemically active coating. Exemplary coatings include those provided from platinum, ruthenium, iridium, or other Group VIII metals, Group VIII metal oxides, or compounds comprising Group VIII metals, and oxides and compounds of titanium, molybdenum, tantalum, and/or mixtures and combinations thereof. Ruthenium oxide and iridium oxide are two preferred compounds for use as an electrochemically active coating on titanium anodes.

In accordance with another aspect of an exemplary embodiment of the invention, the anode comprises a titanium mesh (or other metal, metal alloy, intermetallic mixture, or ceramic or cermet as set forth above) upon which a coating comprising carbon, graphite, a mixture of carbon and graphite, a precious metal oxide, or a spinel-type coating is applied. Preferably, in accordance with one exemplary embodiment, the anode comprises a titanium mesh with a coating comprised of a mixture of carbon black powder and graphite powder.

In accordance with an exemplary embodiment of the invention, the anode comprises a carbon composite or a metal-graphite sintered material. In accordance with other embodiments of the invention, the anode may be formed of a carbon composite material, graphite rods, graphite-carbon coated metallic mesh and the like. Moreover, a metal in the metallic mesh or metal-graphite sintered exemplary embodiment is described herein and shown by example using titanium; however, any metal may be used without detracting from the scope of the present invention.

In accordance with one exemplary embodiment, a wire mesh may be welded to the conductor rods, wherein the wire mesh and conductor rods may comprise materials as described above for anodes. In one exemplary embodiment, the wire mesh comprises of a woven wire screen with 80 by 80 strands per square inch, however various mesh configurations may be used, such as, for example, 30 by 30 strands per square inch. Moreover, various regular and irregular geometric mesh configurations may be used. In accordance with yet another exemplary embodiment, a flow-through anode may comprise a plurality of vertically-suspended stainless steel rods, or stainless steel rods fitted with graphite tubes or rings. In accordance with another aspect of an exemplary embodiment, the hanger bar to which the anode body is attached comprises copper or a suitably conductive copper alloy, aluminum, or other suitable conductive material.

Referring now to FIG. 3, an exemplary flow-through anode 300 suitable for use in accordance with one aspect of an embodiment of the present invention generally comprises a flow-through body portion 301 that is suspended from a bus bar 302. As illustrated in FIG. 3, bus bar 302 is substantially straight and configured to be positioned horizontally in an electrowinning cell. Other configurations may, however, be utilized, such as, for example, "steerhorn" configurations, multi-angled configurations, and the like. Preferably, during use, substantially all of body portion 301 is immersed in electrolyte (i.e., below electrolyte surface 303).

Cathode Characteristics

Figure 4:
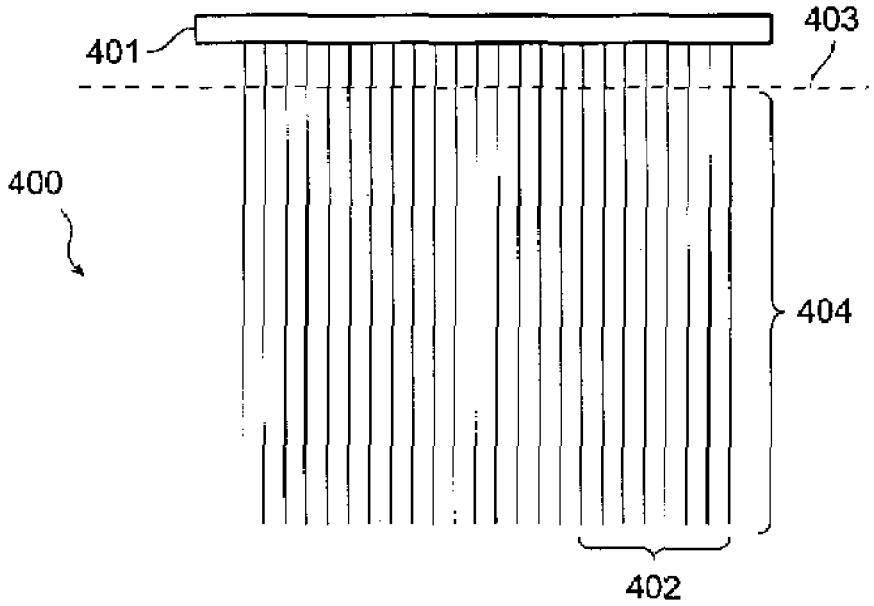
FIG. 4 illustrates the configuration of a flow-through cathode in accordance with various aspects of another exemplary embodiment of the present invention.

Conventional copper electrowinning operations use either a copper starter sheet or a stainless steel or titanium "blank" as the cathode. These conventional cathodes, however, do not permit electrolyte to flow through, and are thus not suitable for the production of copper powder in connection with the various aspects of the present invention. In accordance with one aspect of an exemplary embodiment of the invention, the cathode in electrowinning apparatus 100 is configured to allow flow of electrolyte through the cathode. In accordance with one exemplary embodiment of the present invention, a flow-through cathode, such as cathode 400 illustrated in FIG. 4, is incorporated into the cell as shown in FIG. 2 (e.g., cathode 202). As used herein, the term "flow-through cathode" refers to any cathode configured to enable electrolyte to pass through it. While fluid flow from an electrolyte flow manifold provides electrolyte movement, a flow-through cathode allows the electrolyte in the electrochemical cell to flow through the cathode during the electrowinning process.

Various flow-through cathode configurations may be suitable, including: (1) multiple parallel metal wires, thin rods, including hexagonal rods or other geometries, (2) multiple parallel metal strips either aligned with electrolyte flow or inclined at an angle to flow direction, (3) metal mesh, (4) expanded porous metal structure, (5) metal wool or fabric, and/or (6) conductive polymers. The cathode may be formed of copper, copper alloy, stainless steel, titanium, aluminum, or any other metal or combination of metals and/or other materials. The surface finish of the cathode (e.g., whether polished or unpolished) may affect the harvestability of the copper powder. Polishing or other surface finishes, surface coatings, surface oxidation layer(s), or any other suitable barrier layer may advantageously be employed to enhance harvestability. Alternatively, unpolished or surfaces may also be utilized.

In accordance with various embodiments of the present invention, the cathode may be configured in any manner now known or hereafter devised by the skilled artisan. With reference to FIG. 4, an exemplary flow-through cathode 400 suitable for use in accordance with one aspect of an embodiment of the present invention generally comprises a flow-through body portion 404 comprising multiple thin rods 402 that are suspended from a bus bar 401. Multiple thin rods 402 preferably are approximately the same length, diameter, and material of construction, and are preferably spaced approximately evenly along the length of bus bar 401. As illustrated in FIG. 4, bus bar 401 is substantially straight and configured to be positioned horizontally in an electrowinning cell. Other configurations may, however, be utilized, such as, for example, "steerhorn" configurations, multi-angled configurations, and the like. Moreover, cathode 400 may be unframed (as shown in FIG. 4), framed (as shown with cathode 202 in FIG. 2), may comprise electrical insulators on the ends of thin rods 402, or may have any other suitable structural configuration. Thin rods 402 may have any suitable cross-sectional geometry, such as, for example, round, hexagonal, square, rectangular, octagonal, oval, elliptical, or any other desired geometry. The desired cross-sectional geometry of thin rods 402 may be chosen to optimize harvestability of copper powder and/or to optimize flow and/or mass transfer characteristics of the electrolyte within the electrowinning apparatus.

All or substantially all of the surface area of the portion of the cathode that is immersed in the electrolyte during operation of the electrochemical cell is referred to herein, and generally in the literature, as the "active" surface area of the cathode (designated by area 404 in FIG. 4, the portion of cathode 400 below electrolyte surface 403). This is the portion of the cathode onto which copper powder is formed during electrowinning. In accordance with an exemplary embodiment of the invention, the anodes and cathodes in the electrowinning cell are spaced evenly across the cell, and are maintained as close as possible to optimize power consumption and mass transfer while minimizing electrical short-circuiting of current between the electrodes. While anode/cathode spacing in conventional electrowinning cells is typically about 2 inches or greater from anode to cathode, electrowinning cells configured in accordance with various aspects of the present invention preferably exhibit anode/cathode spacing of from about 0.5 inch to about 4 inches, and preferably less than about 2 inches. More preferably, electrowinning cells configured in accordance with various aspects of the present invention exhibit anode/cathode spacing of about or less than about 1.5 inches. As used herein, "anode/cathode spacing" is measured from the centerline of an anode hanger bar to the centerline of the adjacent cathode hanger bar.

Electrolyte Flow Characteristics

Generally speaking, any electrolyte pumping, circulation, or agitation system capable of maintaining satisfactory flow and circulation of electrolyte between the electrodes in an electrochemical cell such that the process specifications described herein are practical may be used in accordance with various embodiments of the invention.

In accordance with an exemplary embodiment of the invention, the electrolyte flow rate is maintained at a level of from about 0.05 gallons per minute per square foot of active cathode to about 30 gallons per minute per square foot of active cathode. Preferably, the electrolyte flow rate is maintained at a level of from about 0.1 gallons per minute per square foot of active cathode to about 0.75 gallons per minute per square foot of active cathode. It should be recognized that the optimal operable electrolyte flow rate useful in accordance with the present invention will depend upon the specific configuration of the process apparatus as well as the electrolyte chemistry employed, and thus flow rates in excess of about 30 gallons per minute per square foot of active cathode or less than about 0.05 gallons per minute per square foot of active cathode may be optimal in accordance with various embodiments of the present invention. Moreover, electrolyte movement within the cell may be augmented by agitation, such as through the use of mechanical agitation and/or gas/solution injection devices, to enhance mass transfer.

Injection velocity of the electrolyte into the electrochemical cell may be varied by changing the size and/or geometry of the holes or slots through which electrolyte enters the electrochemical cell. For example, with reference to FIG. 2 wherein electrolyte feed is sent through a distributor plate 203 configured having multiple injection holes, if the diameter of the injection holes is decreased, the injection velocity of the electrolyte is increased, resulting in, among other things, increased agitation of the electrolyte. Moreover, the angle of injection of electrolyte into the electrochemical cell relative to the cell walls and the electrodes may be configured in any way desired, through any number of cell walls. Although an approximately horizontal electrolyte injection configuration is illustrated in FIG. 2 for purposes of reference, any number of configurations of differently directed and spaced injection holes are possible. For example, although the injection holes represented in FIG. 2 are approximately parallel to one another and similarly directed, configurations comprising a plurality of opposing injection streams or intersecting injection streams may be beneficial in accordance with various embodiments of the invention. Distributor plate 203 preferably is configured to distribute flow substantially evenly across the surfaces of the cell interior and the electrodes. In accordance with one aspect of an exemplary embodiment of the invention, injection holes near the top of the distributor plate are smaller in diameter than the injection holes near the bottom of the distributor plate, and preferably, the injection holes increase in diameter from the top of the distributor plate to the bottom of the distributor plate. In accordance with an aspect of another exemplary embodiment of the invention, the injection holes in the distributor plate may be configured such that the holes near the center of the plate are smaller in diameter than the holes near the periphery of the plate, and further, the injection holes may increase in diameter from the center of the distributor plate to the periphery of the distributor plate. By adjusting the diameter of the injection holes in the distributor plate(s), electrolyte flow rate and flow velocity through the cell may be optimized. Moreover, electrolyte movement within the cell may be augmented by mechanical agitation, such as through the use of agitation or injection devices, to enhance mass transfer.

Cell Voltage

In accordance with an exemplary embodiment of the invention, overall cell voltage of from about 0.75 to about 3.0 V is achieved, preferably less than about 1.9 V, and more preferably less than about 1.7 V. Through the use of alternate anode reaction chemistries, overall cell voltages that are generally significantly less than those achievable through conventional electrowinning reaction chemistry may be utilized (e.g., 0.5-1.5 V). As such, the mechanism for optimizing cell voltage within the electrowinning cell will vary in accordance with various exemplary aspects and embodiments of the present invention, depending upon the electrowinning reaction chemistry chosen.

Moreover, the overall cell voltage achievable is dependent upon a number of other interrelated factors, including electrode spacing, the configuration and materials of construction of the electrodes, acid concentration and copper concentration in the electrolyte, current density, electrolyte temperature, electrolyte conductivity, and, to a smaller extent, the nature and amount of any additives to the electrowinning process (such as, for example, flocculants, surfactants, and the like).

In addition, the present inventors have recognized that independent control of anode and cathode current densities, together with managing voltage overpotentials, can be utilized to enable effective control of overall cell voltage and current efficiency. For example, the configuration of the electrowinning cell hardware, including, but not limited to, the ratio of cathode surface area to anode surface area, can be modified in accordance with the present invention to optimize cell operating conditions, current efficiency, and overall cell efficiency.

Current Density

The operating current density of the electrowinning cell affects the morphology of the copper powder product and directly affects the production rate of copper powder within the cell. In general, higher current density decreases the bulk density and particle size of the copper powder and increases surface area of the copper powder, while lower current density increases the bulk density of copper product (sometimes resulting in cathode copper if too low, which generally is undesirable). For example, the production rate of copper powder by an electrowinning cell is approximately proportional to the current applied to that cell—a cell operating at, say, 100 A/ft$^2$ of active cathode produces approximately five times as much copper powder in a given time as a cell operating at 20 A/ft$^2$ of active cathode, all other operating conditions, including active cathode area, remaining constant. The current-carrying capacity of the cell furniture is, however, one limiting factor. Also, when operating an electrowinning cell at a high current density, the electrolyte flow rate through the cell may need to be adjusted so as not to deplete the available copper in the electrolyte for electrowinning. Moreover, a cell operating at a high current density may have a higher power demand than a cell operating at a low current density, and as such, economics also plays a role in the choice of operating parameters and optimization of a particular process.

In accordance with an exemplary embodiment of the invention, the operating current density of the electrowinning apparatus ranges from about 10 A/ft$^2$ to about 200 A/ft$^2$ of active cathode, and preferably is on the order of about 100 A/ft$^2$ of active cathode when conventional electrowinning reaction chemistry is utilized within the electrowinning apparatus. Use of alternative anode reaction chemistries, such as, for example, non-oxygen evolving reaction chemistries, may allow for current densities that are generally higher than those achievable through conventional electrowinning reaction chemistry, up to as high as 700 A/ft$^2$ or higher. As such, the mechanism for optimizing operating current density within the electrowinning cell will vary in accordance with various exemplary aspects and embodiments of the present invention, depending upon the electrowinning reaction chemistry chosen.

Temperature

In accordance with one aspect of an exemplary embodiment of the present invention, the temperature of the electrolyte in the electrowinning cell is maintained at from about 40° F. to about 150° F. In accordance with one preferred embodiment, the electrolyte is maintained at a temperature of from about 90° F. to about 140° F. Higher temperatures may, however, be advantageously employed. For example, in direct electrowinning operations, temperatures higher than 140° F. may be utilized. Alternatively, in certain applications, lower temperatures may advantageously employed. For example, when direct electrowinning of dilute copper-containing solutions is desired, temperatures below 85° F. may be utilized.

The operating temperature of the electrolyte in the electrowinning cell may be controlled through any one or more of a variety of means well known in the art, including, for example, heat exchange, an immersion heating element, an in-line heating device (e.g., a heat exchanger), or the like, preferably coupled with one or more feedback temperature control means for efficient process control.

Acid Concentration

In accordance with an exemplary embodiment of the present invention, the acid concentration in the electrolyte for electrowinning may be maintained at a level of from about 5 to about 250 grams of acid per liter of electrolyte. In accordance with one aspect of a preferred embodiment of the present invention, the acid concentration in the electrolyte is advantageously maintained at a level of from about 150 to about 205 grams of acid per liter of electrolyte, depending upon the upstream process.

Copper Concentration

In accordance with an exemplary embodiment of the present invention, the copper concentration in the electrolyte for electrowinning is advantageously maintained at a level of from about 5 to about 40 grams of copper per liter of electrolyte. Preferably, the copper concentration is maintained at a level of from about 10 g/L to about 30 g/L. However, various aspects of the present invention may be beneficially applied to processes employing copper concentrations above and/or below these levels, with lower copper concentration levels of from about 0.5 g/L to about 5 g/L and upper copper concentration levels of from about 40 g/L to about 50 g/L being applied in some cases.

Iron Concentration

In accordance with an exemplary embodiment of the present invention, the total iron concentration in the electrolyte is maintained at a level of from about 0.01 to about 3.0 grams of iron per liter of electrolyte when utilizing conventional electrowinning chemistry, and at a level of from about 20 g/L to about 50 g/L when utilizing alternative anode reaction chemistries. It is noted, however, that the total iron concentration in the electrolyte may vary in accordance with various embodiments of the invention, as total iron concentration is a function of iron solubility in the electrolyte. Iron solubility in the electrolyte varies with other process parameters, such as, for example, acid concentration, copper concentration, and temperature. In accordance with one aspect of an exemplary embodiment of the invention, when conventional electrowinning chemistry is utilized within the electrowinning cell, the iron concentration in the electrolyte is maintained at as low a level as possible, maintaining just enough iron in the electrolyte to counteract the effects of manganese in the electrolyte, which has a tendency to "coat" the surfaces of the electrodes and detrimentally affect cell voltage.

Harvest of Copper Powder

While in situ harvesting configurations may be desirable to minimize movement of cathodes and to facilitate the removal of copper powder on a continuous basis, any number of mechanisms may be utilized to harvest the copper powder product from the cathode in accordance with various aspects of the present invention. Any device now known or hereafter devised that functions to facilitate the release of copper powder from the surface of the cathode to the base portion of the electrowinning apparatus, enabling collection and further processing of the copper powder in accordance with other aspects of the present invention, may be used. The optimal harvesting mechanism for a particular embodiment of the present invention will depend largely on a number of interrelated factors, primarily current density, copper concentration in the electrolyte, electrolyte flow rate, electrolyte temperature, cathode substrate material, and associated surface condition. Other contributing factors include the level of mixing within the electrowinning apparatus, the frequency and duration of the harvesting method, and the presence and amount of any process additives (such as, for example, flocculant, surfactants, and the like).

In situ harvesting configurations, either by self-harvesting (described below) or by other in situ devices, may be desirable to minimize the need to remove and handle cathodes to facilitate the removal of copper powder from the electrowinning cell. Moreover, in situ harvesting configurations may advantageously permit the use of fixed electrode cell designs. As such, any number of mechanisms and configurations may be utilized.

Examples of possible harvesting mechanisms include vibration (e.g., one or more vibration and/or impact devices affixed to one or more cathodes to displace copper powder from the cathode surface at predetermined time intervals), a pulse flow system (e.g., electrolyte flow rate increased dramatically for a short time to displace copper powder from the cathode surface), use of a pulsed power supply to the cell, use of ultrasonic waves, and use of other mechanical displacement means to remove copper powder from the cathode surface, such as intermittent or continuous air bubbles. Alternatively, under some conditions, "self-harvest" or "dynamic harvest" may be achievable, when the electrolyte flow rate is sufficient to displace copper powder from the cathode surface as it is formed, or shortly after deposition and crystal growth occurs.

As noted above, the surface finish of the cathode, may affect the harvestability of the copper powder. Accordingly, polishing or other surface finishes, surface coatings, surface oxidation layer(s), or any other suitable barrier layer may advantageously be employed to enhance harvestability.

In accordance with an aspect of one embodiment of the invention, fine copper powder that is carried through the cell with the electrolyte is either removed via a suitable filtration, sedimentation, or other fines removal/recovery system.

The present invention has been described above with reference to a number of exemplary embodiments. It should be appreciated that the particular embodiments shown and described herein are illustrative of the invention and its best mode and are not intended to limit in any way the scope of the invention as set forth in the claims. Those skilled in the art having read this disclosure will recognize that changes and modifications may be made to the exemplary embodiments without departing from the scope of the present invention. For example, various aspects and embodiments of this invention may be applied to electrowinning of metals other than copper, such as nickel, zinc, cobalt, and others. Although certain preferred aspects of the invention are described herein in terms of exemplary embodiments, such aspects of the invention may be achieved through any number of suitable means now known or hereafter devised. Accordingly, these and other changes or modifications are intended to be included within the scope of the present invention.

What is claimed is:

1. An apparatus for producing metal powder by electrowinning comprising:

at least two electrowinning cells wherein each said electrowinning cell comprises at least one flow-through anode and at least one flow-through cathode; and at least one distributor plate having a plurality of injection holes configured for distribution of electrolyte, wherein said at least one distributor plate is located between the at least two electrowinning cells.

2. The apparatus of claim 1 further comprising a base portion for collecting metal powder.

3. The apparatus of claim 2, wherein said base portion is conical.

4. The apparatus of claim 1, wherein said at least one flow-through anode comprises at least one of titanium, tantalum, zirconium, niobium, nickel, stainless steel, a metal alloy, an intermetallic mixture, a ceramic or cermet containing one or more valve metals, or combinations thereof.

5. The apparatus of claim 1, wherein said at least one flow-through anode comprises an electrochemically active coating.

6. The apparatus of claim 1, wherein said coating comprises platinum, ruthenium, iridium, other Group VIII metals, Group VIII metal oxides, oxides and compounds of titanium, molybdenum, tantalum, or combinations thereof.

7. The apparatus of claim 1, wherein said at least one flow-through cathode comprises at least one of: copper, a copper alloy, stainless steel, other specialty steel alloys, titanium, aluminum, zinc, or combinations thereof.

8. The apparatus in claim 1, wherein said metal powder is copper powder.

9. The apparatus in claim 1, further comprising at least one harvesting mechanism in contact with said at least one flow-through cathode to facilitate release of said metal powder from said cathode.

10. The apparatus in claim 9, wherein said harvesting mechanism is a vibrator, an impact device, a pulse flow system, a pulsed power supply, an ultrasonic wave generator, an air bubble generator, or a combination thereof.

11. The apparatus in claim 1, further comprising a settling tank connected to said base wherein metal powder particles are gravitationally separated from excess electrolyte solution.

12. The apparatus in claim 1, further comprising a device installed adjacent said at least one electrowinning cell configured to collect acid mist.

13. An apparatus for producing copper powder by electrowinning comprising:

a plurality of electrowinning cells; wherein each said electrowinning cell comprises at least one flow-through anode and at least one flow-through cathode;

a distributor plate disposed between two sequential electrowinning cells in said plurality of electrowinning cells wherein said distributor plate comprises a plurality of injection holes configured for distribution of electrolyte between said two electrowinning cell;

at least one harvesting mechanism to facilitate release of said copper powder from said at least one flow-through cathode; and at least one base portion for collecting copper powder.

14. The apparatus of claim 13, further comprising a settling tank connected to said base wherein copper powder particles are gravitationally separated from excess electrolyte solution.

15. The apparatus of claim 14, wherein said at least one flow-through cathode comprises a plurality of rods.

16. The apparatus of claim 14, wherein said at least one flow-through cathode comprises at least one of: copper, copper alloy, stainless steel, titanium, aluminum, zinc, or combinations thereof.

17. The apparatus of claim 14, wherein said at least one flow-through cathode is electropolished or chemically passivated stainless steel.

18. The apparatus of claim 14, further comprising a device installed adjacent said at least one electrowinning cell configured to process acid mist.

19. The apparatus of claim 14, wherein said harvesting mechanism is a vibrator, an impact device, a pulse flow system, a pulsed power supply, an ultrasonic wave generator, an air bubble generator, or a combination thereof.

* * * * *